United States Patent [19]

Thornborrow

[11] Patent Number: 4,886,235

[45] Date of Patent: Dec. 12, 1989

[54] DISPLAY POST

[76] Inventor: John W. T. K. Thornborrow, Tudor Lodge, Duffield Road, Sonning, Berkshire, England

[21] Appl. No.: 306,218

[22] Filed: Feb. 3, 1989

Related U.S. Application Data

[63] Continuation of Ser. No. 226,205, Jul. 29, 1988, abandoned, which is a continuation-in-part of Ser. No. 85,900, Aug. 14, 1987, abandoned.

[51] Int. Cl.[4] ..... E04G 5/06; A47G 29/02

[52] U.S. Cl. ..... 248/225.1; 211/193; 248/243

[58] Field of Search ..... 248/222.2, 222.3, 243, 248/235, 225.1, 224.4; 108/106, 107, 108, 110; 211/90, 187, 193, 190

[56] References Cited

U.S. PATENT DOCUMENTS

| | | | |
|---|---|---|---|
| 1,308,066 | 7/1919 | Hayes . | |
| 1,940,454 | 12/1933 | Karnes | 248/243 X |
| 2,653,718 | 9/1953 | Woodward . | |
| 2,747,821 | 5/1956 | Falk . | |
| 3,312,442 | 4/1967 | Moeller . | |
| 3,339,751 | 9/1967 | Bard | 211/187 X |
| 3,620,490 | 11/1971 | Roberts . | |
| 3,645,486 | 2/1972 | Ferdinand | 248/243 |
| 3,862,524 | 1/1975 | McCrackin | 248/243 X |
| 4,133,433 | 1/1979 | Wolf | 248/243 X |

FOREIGN PATENT DOCUMENTS

| | | | |
|---|---|---|---|
| 645876 | 11/1928 | France | 248/243 |
| 2546604 | 11/1984 | France | 248/243 |
| 2181637 | 4/1987 | United Kingdom | 248/243 |

OTHER PUBLICATIONS

Brochure, J.R. Group PLC, at Trade Exhibition in New York City, New York in Jun. 1986 at Pam International Booth.

*Primary Examiner*—J. Franklin Foss

*Attorney, Agent, or Firm*—Finnegan, Henderson, Farabow, Garrett & Dunner

[57] ABSTRACT

A display post, combination of display post and display arm and/or connecting member, and an assembly is provided wherein the display post comprises a hollow elongate support member, a series of spaced apertures in a wall of said support member and cover members removably mounted on said support member so as to leave exposed at least said series of spaced apertures.

12 Claims, 1 Drawing Sheet

DISPLAY POST

This application is a continuation of application Ser. No. 226,205, filed July 29, 1988, now abandoned, which is a continuation-in-part of application Ser. No. 085,900, filed Aug. 14, 1987, now abandoned.

FIELD OF THE INVENTION

This invention concerns display posts of the type used for mounting and displaying goods in public places, for example shops, exhibitions, museums and the like.

Since the advent of "theme" presentation of goods, and taking into consideration market research analyses which have shown that frequent changing of display materials in shops and the like improves turnover of the goods displayed, there has arisen a need to provide a display post for mounting and displaying such goods of which the design can be quickly and cheaply altered to suit commercial needs. The present invention aims to provide a display post which will fullfil this need.

SUMMARY OF THE INVENTION

According to the present invention there is provided a display post comprising a hollow elongate support member of rectangular cross-section with opposed narrower sides each having a series of spaced slots therein extending along the length thereof and opposed wider sides, a pair of cover members, and means removably mounting the cover members on said support members, each cover member being adapted to cover a wider side of the support member, the cover members being spaced apart in the region of said slots to expose at least that part of each narrower side of the support member containing said slots, said means removably mounting the cover members comprising a series of studs upstanding from each wider side of the support member and exposed along the length thereof, a plastics button having an enlarged head mounted on each said stud and a T-section slot in the rear surface of each cover member slidably engageable with said plastics buttons.

Said studs may be welded to the support member. Preferably the studs are threaded or serrated and the plastics buttons a free-fit thereon to firmly mount the plastics buttons on the studs.

The plastics buttons are preferably formed, e.g., moulded, from a plastics material having self-lubricating properties, such as nylon or polypropylene.

The display post may be used in any orientation or manner convenient for displaying and supporting goods. For example, the display post may be used in conjunction with display arms inserted into the apertures such that an upstanding display post supports a display arm extending outwardly therefrom which carries clothing or other goods. Alternatively two or more display posts according to the invention may be arranged as an assembly linked by connecting members inserted into the apertures; and indeed display posts could be assembled one on top of another in such assemblies to give a display facility of varying height.

Display posts according to the invention may be mounted in a free standing manner by providing suitable mounting means at one end of the display post, or the display post may be mounted partly or fully to a wall by utilising the apertures in the display post or by other suitable means.

It will be appreciated that a display post according to the present invention may have any convenient cross-sectional shape.

The cover members may conveniently be made from extruded or moulded material, for example extruded aluminium or plastics material. The cover members may also be formed from wood. Thus any desired finish, colour or design of cover member may be easily achieved.

It will be appreciated that according to the present invention the cover member need not be a load bearing part of the display post, and as such may be made of any material desired. For example, for shop-fitting purposes it may be desired to impart to the display post a required colour and/or shape, and to this end the cover member may be made from plastics or other suitable material, for example, may be hollow and may be in any desired shape, colour or finish.

In use, an assembly according to this invention may comprise a display post according to the preferred embodiment together with one or more display arms or connecting members. Each said display arm or connecting member may comprise an arm portion extending outwardly from the display post for displaying goods thereupon or connecting the display post with other means. An end portion of a said display arm or connection member attached to the display post may comprise any convenient post engaging means to engage one or more of the series of spaced apertures in the display post, and may engage a first said aperture on the arm portion side of the display post and a second said aperture on the opposite side thereof, and said second aperture may be spaced along the display post from the first said aperture being preferably lower down a vertical said display post than the first said aperture. The said display arm, when mounted on a display post as aforesaid may extend from the display post at any desired angle, and may have one or more irregularities thereon to locate items being displayed, for example the display arm may comprise a series of pegs attached to a top surface thereof in order to locate coat hangers hanging from the display arm.

DETAILED DESCRIPTION OF DRAWINGS

Figure 1:
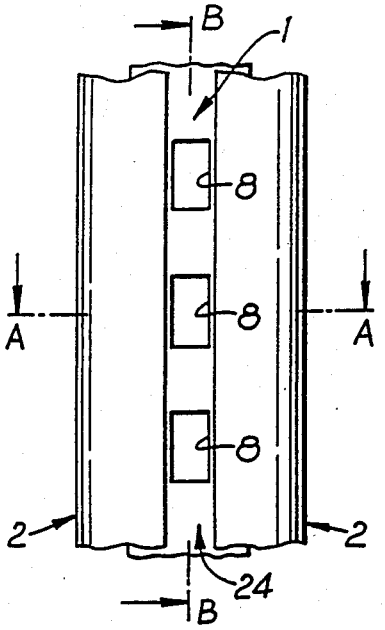
FIG. 1 is a front or rear view of a display post according to this invention.
Figure 2:
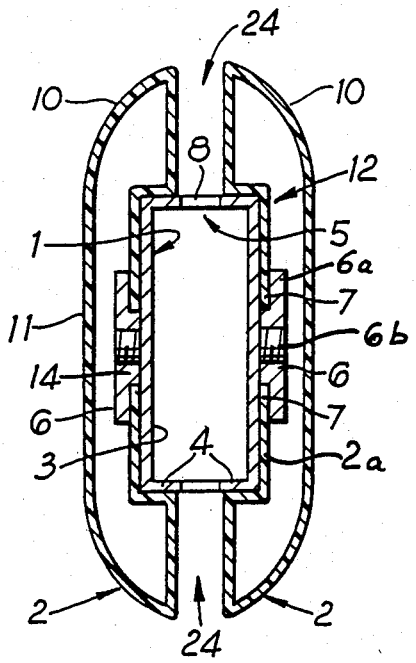
FIG. 2 is a sectional view of the display post of FIG. 1 along the line AA.

Referring to the drawings, a support member 1 of rectangular box section steel is covered by a cover member 2 on either side thereof so that each cover member 2 fully covers each wider side 3 of the support member 1 and a covered portion 4 of each narrower side 5 of the support member 1. Each said cover member 2 is retained in position against the support member 1 by a series of spaced buttons 6 each of which has an enlarged head *6a* which engages the margins 7 of a cover member 2 on either side of a longitudinal slot 14 provided in a rear wall *2a* of the cover member. The buttons 6, which are preferably formed from a plastics material, such as nylon or polypropylene, having self-lubricating properties, are mounted on threaded or serrated studs *6b* secured, e.g., welded, to the support member 1. Preferably the buttons 6 are force-fitted over the studs 6*b* so as to be firmly secured thereto.

Each said narrower side 5 of the support member 1 comprises a series of rectangular slots 8 spaced from one another and aligned vertically down the length of the support member 1. The rectangular slots 8 are left exposed by the cover members 2 terminating on either side of each said series of slots 8 leaving a gap 24 therebetween to allow insertion of a display arm 15 therethrough.

Figure 3:
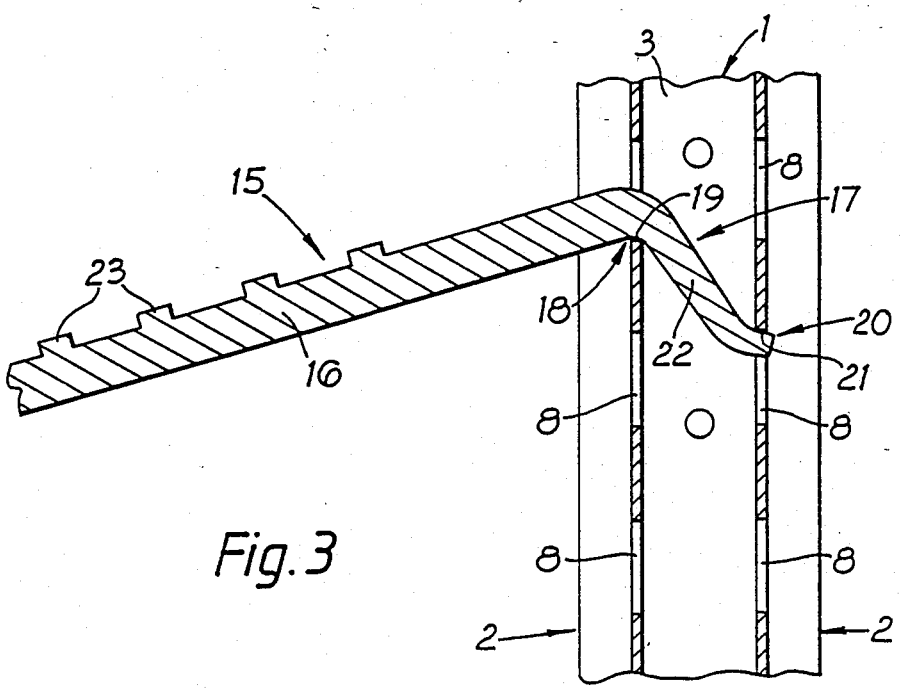
FIG. 3 is a sectional view of the display post of FIG. 1 along the line BB including a side sectional view of a display arm in position in the display post.

Each cover member 2 is conveniently made from extruded plastics material and is of hollow construction. The cover member 2 is of generally rectangular form having two curved portions 10 on either side of a central portion 11 and a rectangular indentation 12 to accept the display post therein. The inner wall 2*a* comprises two edge margins 7 on either side of a longitudinal slot 14 along its full length to accept the series of buttons 6 therein. The support member 1 in the region of the spaced slots 8 is left uncovered. Referring to FIG. 3, the display arm 15 comprises an arm portion 16 extending outwardly from the rear of the display post and angled slightly downwards from the horizontal. Extending into the display post from the arm portion 16 is an end portion 17 which comprises a rear, downwardly curved, post engaging portion 18 supported by a lower lip 19 of a said rectangular slot 8, a front post engaging portion 20 extending forwardly of the display arm 15 and radially spaced therefrom by a connecting portion 22, prevented from moving upwardly under the weight of the display arm 15 which is pivoted about the rear post engaging portion 18, by an upper lip 21 of a said rectangular slot 8. The display arm comprises a series of pegs 23 spaced along an upper surface thereof to provide location for goods (not shown) hung from the display arm 15. The two series of spaced slots 8 in the support member 1 are arranged opposite one another in front and rear narrower sides 5 of the support member 1, and are vertically spaced from one another such that a display arm 15 in position in the display post will occupy a slot 8 one lower down the series of spaced slots 8 on the front side of the display post than the slot 8 occupied on the rear side of the display post.

In order to insert the display arm 15 into position in the display post the front post engaging portion 20 is inserted through a chosen first slot 8 into the rear of the support member 1, the display arm 15 is then moved to a horizontal position whereupon the front post engaging portion 20 will lie inside the support member 1 facing out of the front of the support member 1 through a second slot 8 spaced one lower in the series of slots 8 than the slot 8 entered in the rear of the support member 1. The arm portion 16 is now allowed to drop below horizontal whilst pivoting about the rear post-engaging portion 18, whereupon the front post engaging portion 20 will emerge through the second slot 8 and the display arm 15 will be held in position slightly below the horizontal by a lower lip 19 of the first slot 8 bearing upwards against the rear post engaging portion 18 and by an upper lip 21 of the second slot 8 bearing down upon the front post engaging portion 20.

I claim:

1. A display post comprising a hollow elongate support member of rectangular cross-section with opposed narrower sides each having a series of spaced slots therein extending along the length thereof and opposed wider sides, a pair of cover members, and means removably mounting the cover members on said support members, each cover member being adapted to cover a wider side of the support member, the cover members being spaced apart in the region of said slots to expose at least that part of each narrower side of the support member containing said slots, said means removably mounting the cover members comprising a series of studs upstanding from each wider side of the support member and spaced along the length thereof, a plastics button having an enlarged head mounted on each said stud and a T-section slot in the rear surface of each cover member slidably engageable with said plastics buttons.

2. A display post according to claim 1, wherein said studs are welded to the support member.

3. A display post according to claim 1, wherein said studs are threaded or serrated and said plastics buttons are a force fit thereon.

4. A display post according to claim 1, wherein the corresponding slots in each said series are opposite one another.

5. A display post according to claim 1, wherein the slots are rectangular and aligned longitudinally of the support member.

6. A display post according to claim 1, wherein each said cover member is shaped to fit closely against one of the wider sides and part of each of the two narrower sides of the support member.

7. A display post according to claim 1, wherein each cover member is hollow and has a slot in a rear wall thereof and extending over the length thereof.

8. A display post according to claim 1, wherein each said cover member is extruded from plastics material.

9. A display post according to claim 1, in combination with at least one display arm engaged with said apertures and extending outwardly of the display post.

10. A combination according to claim 9, wherein an end portion of said display arm is adapted to be inserted through an aperture in one side of the support member and to engage an aperture in the opposite side of the support member.

11. A combination according to claim 10, wherein said apertures are offset from one another.

12. A combination according to claim 9, wherein the display arm has means thereon for locating items to be displayed.

* * * * *